US006178948B1

(12) United States Patent
Garrick et al.

(10) Patent No.: US 6,178,948 B1
(45) Date of Patent: Jan. 30, 2001

(54) THROTTLE LEVER ASSEMBLY

(75) Inventors: Robert David Garrick; Mary Lyko Wallace, both of Rochester; Donald Ray Read, Bergen, all of NY (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/244,310

(22) Filed: Feb. 4, 1999

(51) Int. Cl.[7] ..... F02P 5/00
(52) U.S. Cl. ..... 123/400; 123/406.74
(58) Field of Search ..... 123/400, 406.74, 123/337; 251/305; 261/65

(56) References Cited

U.S. PATENT DOCUMENTS 4,576,762 * 3/1986 Griffin et al. ..... 261/65
4,715,581 * 12/1987 Myers ..... 251/308
5,148,787 * 9/1992 Ganser ..... 123/337
5,263,449 * 11/1993 Swartzendruber ..... 123/400
5,448,974 * 9/1995 Toda ..... 123/400
5,762,044 * 6/1998 Hollister et al. ..... 123/400
5,878,715 * 3/1999 Hernandez et al. ..... 123/337

* cited by examiner

*Primary Examiner*—Henry C. Yuen
*Assistant Examiner*—Mahmoud M Gimie
(74) *Attorney, Agent, or Firm*—John A. VanOphem

(57) ABSTRACT

A throttle lever assembly for controlling the air intake of a throttle body of an internal combustion engine includes a return cam secured to an end of a throttle shaft. The return cam, formed of a planar metal plate, has a channel disposed about a portion of its periphery for receiving an accelerator cable. The channel is formed of alternately offset fingers having fluke-shaped end portions to provide substantially continuous walls of the channel and a cable seat formed of alternately offset fingers. In addition, the return cam may include a cruise stud extending axially from the outer surface of the cam return, an idle stop lever and a wide open stop lever.

11 Claims, 4 Drawing Sheets

THROTTLE LEVER ASSEMBLY

TECHNICAL FIELD

The present invention relates to a throttle lever assembly for controlling the delivery of air to the combustion chamber of an internal combustion engine.

BACKGROUND OF THE INVENTION

In a conventional air/fuel system for an internal combustion engine, a throttle body assembly provides a means for controlling the air provided to the engine in response to the operator's actuation of an accelerator pedal or command from a cruise control system. Generally, the throttle body includes a lever assembly mounted pivotally to a throttle housing that controls the opening of a throttle valve. The degree of rotation of the lever assembly is directly proportional to the opening of the throttle valve which provides air to the engine.

Typically, the throttle lever assembly has a number of components and subassemblies attached to a throttle shaft, each of which perform a specific function. One such subassembly is a return cam mounted to one end of the shaft. The return cam alters the engine's acceleration in response to input provided by the operator. The return cam may be formed of plastic molded onto a metal insert, or two metal pieces joined together. The return cam includes a U-shaped channel for receiving an accelerator cable which has another end interconnected to the accelerator pedal.

When the accelerator pedal is depressed, the cable is retracted to rotate the lever assembly to open the throttle valve which increases the amount of air provided to the engine. The lever assembly is rotated back to its initial or idle position by a return spring when the accelerator pedal is released or pressure on the pedal is reduced. The spring is maintained coaxially about the shaft by a spring retainer mounted to the shaft inboard of the throttle cam.

An idle stop lever extends radially from the shaft and is oriented such that the throttle valve is opened a small amount to the idle or shipping air position when the idle stop lever engages an idle stop screw threaded within a depending member of the housing. The idle stop screw is used to adjust the idle position of the lever assembly. The idle stop lever may also include a second engagement surface to provide a wide open throttle stop for the shaft and lever assembly.

The lever assembly may also include a cruise control lever mounted to the end of the shaft, abutting the outer surface of the return cam. The cruise control lever extends radially from the shaft at a predetermined angle and distance to engage a cable or linkage of the cruise control system which provides control of the throttle body independent of the operator input. A stud extends axially outward from the end of the idle lever to provide a means to engage the linkage or cable of the cruise control system.

This throttle lever assembly functions adequately for its intended purpose, however, the assembly is complex, requiring a number of discrete parts. Consequently, the process of manufacturing and assembling the throttle lever assembly is costly and time consuming.

For instance, the traditional process of manufacturing and assembling the throttle lever assembly described heretofore includes the steps of independently manufacturing each of the subassemblies. For the cruise lever assembly, the stud is machined on a screw machine and the cruise lever is stamped on a punch press. The stud is then spun onto the cruise lever. For the return cam, the base lever and the cam profile are each stamped on a punch press. The cam profile is then locked with the base lever. The idle stop lever is stamped and heat treated. The spring retainer is stamped on a punch press. Each of these subassemblies is then plated before they are placed on the throttle shaft and the shaft is spun over to secure the subassemblies thereto.

SUMMARY OF THE INVENTION

The present invention provides a relatively inexpensive solution for manufacturing a return cam by forming the return cam from a single metal plate. Furthermore, the return cam may also eliminate the number of components and subassemblies required to produce a throttle lever assembly by incorporating the subassemblies therein.

An object of the present invention is to provide a throttle lever assembly having a channel formed by a plurality of fingers alternately offset wherein the end portions of the fingers may be swaged to form flukes to provide substantially continuous walls of the channel.

Another object is to provide a throttle body having a throttle lever assembly wherein the return cam is integrated with a return spring retainer and a stud for engagement with a cruise control system to reduce the number of parts in the assembly and thereby reduce the cost and time to manufacture and assemble the components.

Another object of the invention is to provide a throttle body having a throttle lever assembly wherein the return cam is integrated with a return spring retainer and a stud for engagement with a cruise control system to reduce the dimensions of the assembly and thereby reduce the packaging room required for the throttle lever assembly in the engine compartment.

These and other objects, advantages and features of the present invention will become more apparent from the following description and drawings.

BRIEF DESCRIPTION OF THE DRAWINGS

The present invention will now be described, by way of example only, with reference to the accompanying drawings in which.

DESCRIPTION OF THE PREFERRED EMBODIMENT

Figure 1:
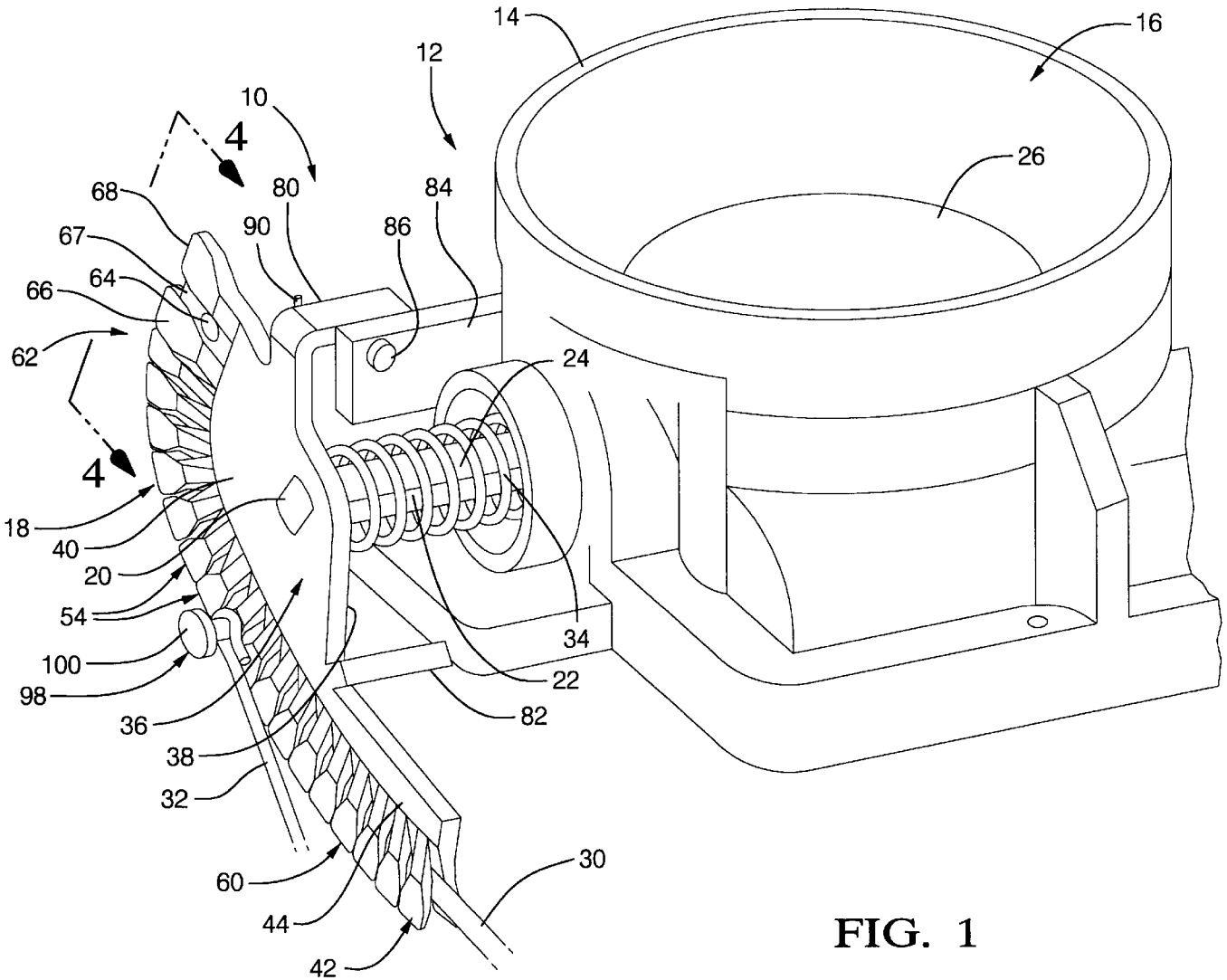
FIG. 1 is a perspective view of a throttle lever assembly embodying the present invention shown mounted to a throttle body of an internal combustion engine.

Referring to FIG. 1, a throttle lever assembly in accordance with the present invention is generally designated 10. The throttle lever assembly 10 is shown as a subassembly of a throttle body 12 which includes a throttle housing 14 having an air intake opening 16 for providing air to the combustion chambers of an internal combustion engine (not shown). The throttle lever assembly 10 comprises a return cam 18 secured to a first end 20 of a shaft 22 that has a second end 24 pivotally engaged with the throttle housing 14 through the intake opening 16. A circular vane 26 is secured within an axial slot 28 (see FIG. 2) disposed in the second end 24 of the shaft 22 to provide valving action for the air intake opening 16 when the shaft is rotated. In the idle position (shown in FIG. 1), the vane 26 is in a slightly open position, and in the wide open position, the vane is in a predetermined open position.

The rotation of the throttle lever assembly 10 is controlled by the operator or a cruise control system (not shown). The operator controls the rotation of the lever assembly 10 by depressing an accelerator pedal (not shown), which pulls an accelerator cable 30 that is attached to the return cam 18. Similarly, the cruise control system is interconnected to the lever assembly 10 by a second cable or linkage 32. When the cruise control system is actuated by the operator, the system pulls the second cable 32 to rotate the throttle lever assembly 10 to a position set by the operator. A return spring 34 disposed coaxially about the shaft 22 returns the lever assembly 10 back to the idle position (as shown in FIG. 1) when the operator or cruise control system reduces tension on their respective cables 30, 32 to close the throttle valve 26.

Figure 2:
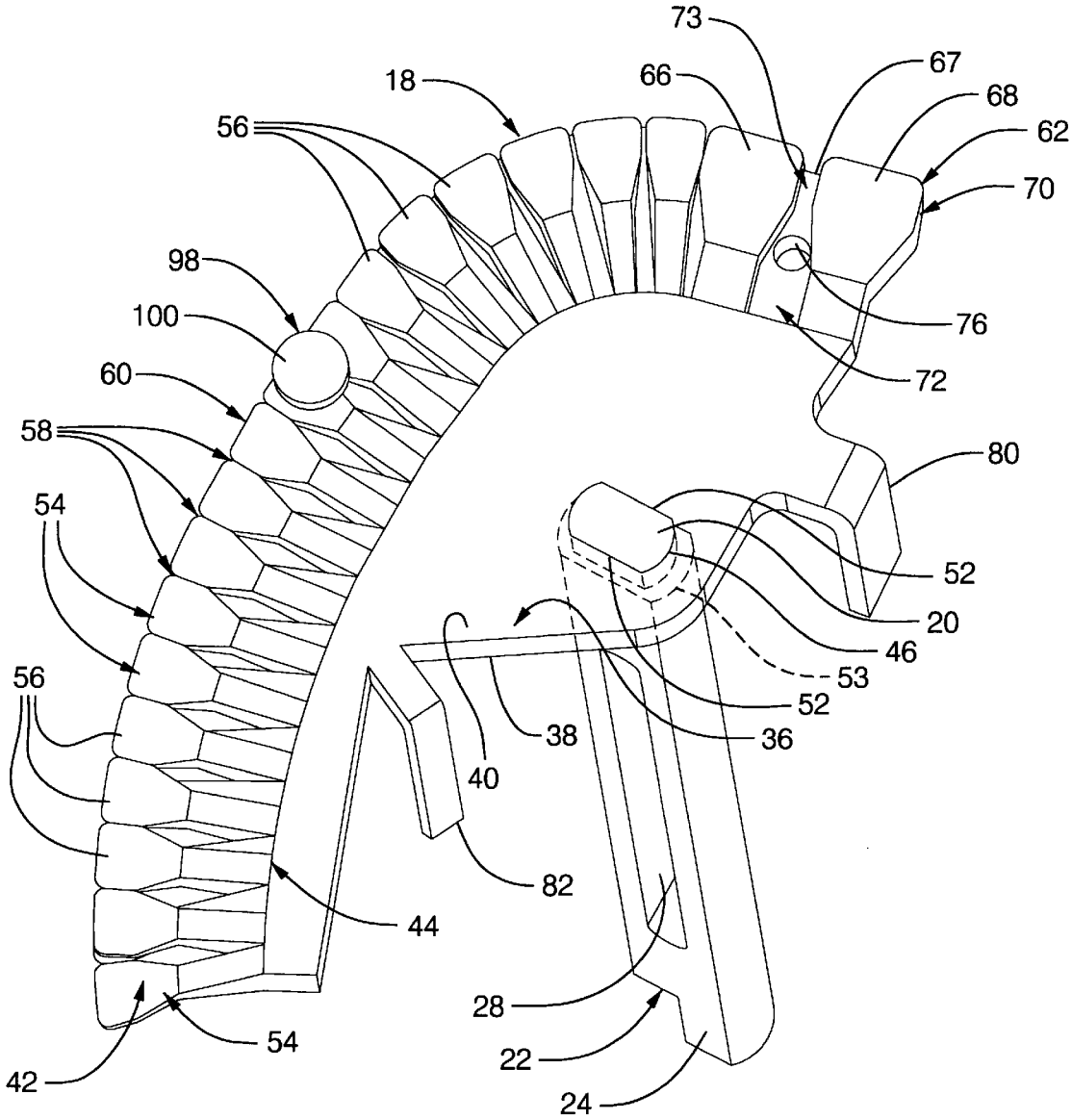
FIG. 2 is a perspective view of a return cam and a throttle shaft, shown in broken lines, of the throttle lever assembly of FIG. 1.

Referring to FIG. 2, the return cam 18, formed of a planar metal plate (i.e. steel), includes a planar body portion 36 defined by inner and outer radial surfaces 38, 40. A generally U-shaped or V-shaped channel 42 is disposed along an eccentric portion of the outer periphery 44 of the body portion 36 of the return cam 18. The channel 42 opens radially outward for receiving the accelerator cable 30 (see FIG. 1). The body portion 36 of the return cam 18 includes a bore 46 having a shape complementary to the cross section of the first end 20 of the shaft 22 which is circular having a pair of opposing milled planar surfaces 52 which prevents rotational translation of the return cam 18 relative to the shaft 22. The shaft 22 is secured to the return cam 18 by spinning over the first end 20 of the shaft 22 extending through the bore 46 at 53 to prevent axial translation of the return cam 18.

Figure 3:
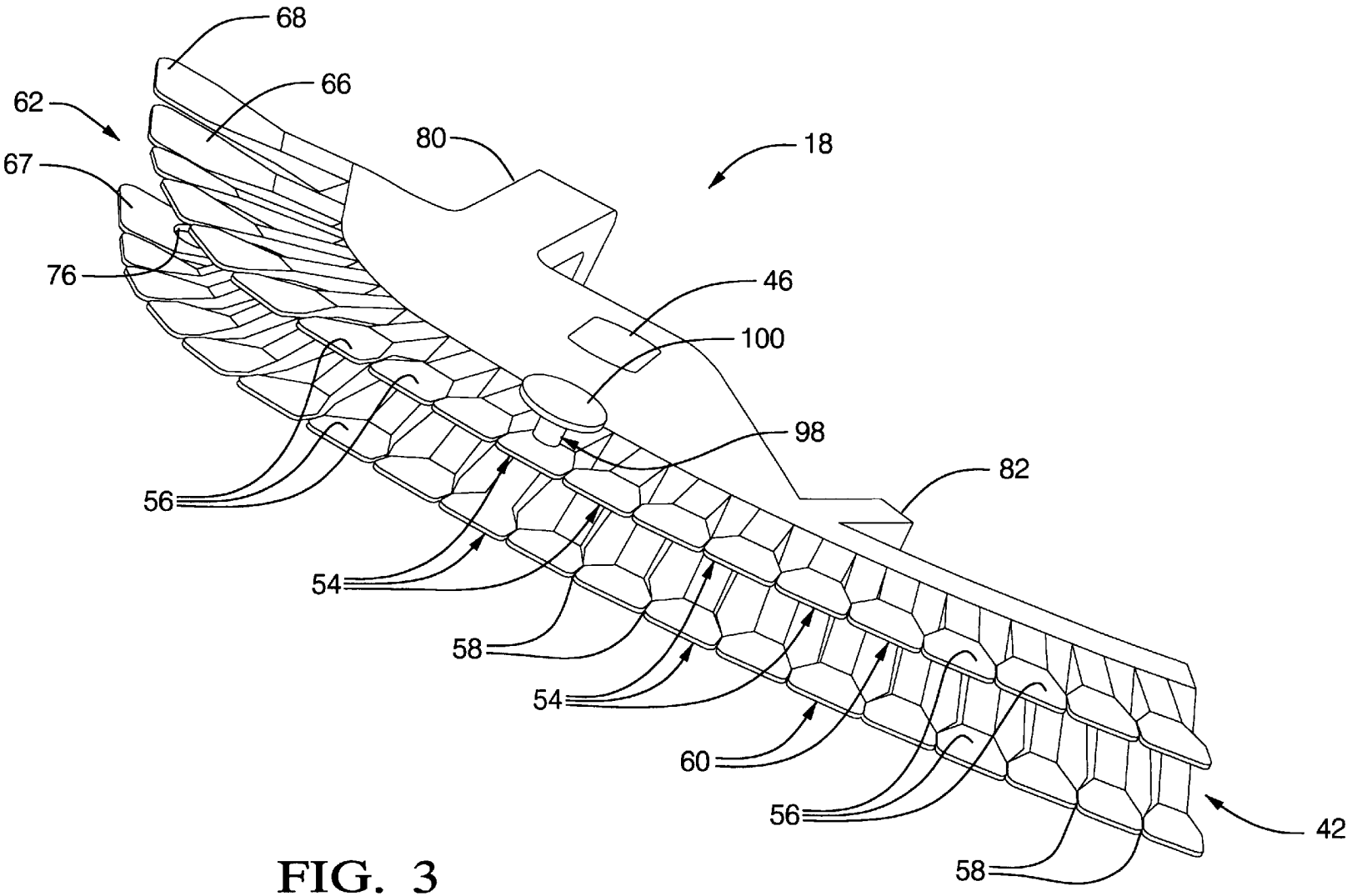
FIG. 3 is a perspective view of the return cam of the throttle lever assembly of FIG. 1.

As best shown in FIGS. 2 and 3, the channel 42 of the return cam 18 is formed of a plurality of alternately offset fingers 54. The fingers 54 are offset sufficiently to ensure that the channel 42 can receive and retain the accelerator cable 30 (see FIG. 1) during the operation of the lever assembly 10. The ends of the fingers 54 are also swaged to provide flukes 56 wherein the expansion of the fingers substantially reduces or eliminates the spacing 58 between the flukes 56 of the adjacent offset fingers 54 to provide a pair of substantially continuous walls 60 of the channel 42.

Figure 4:
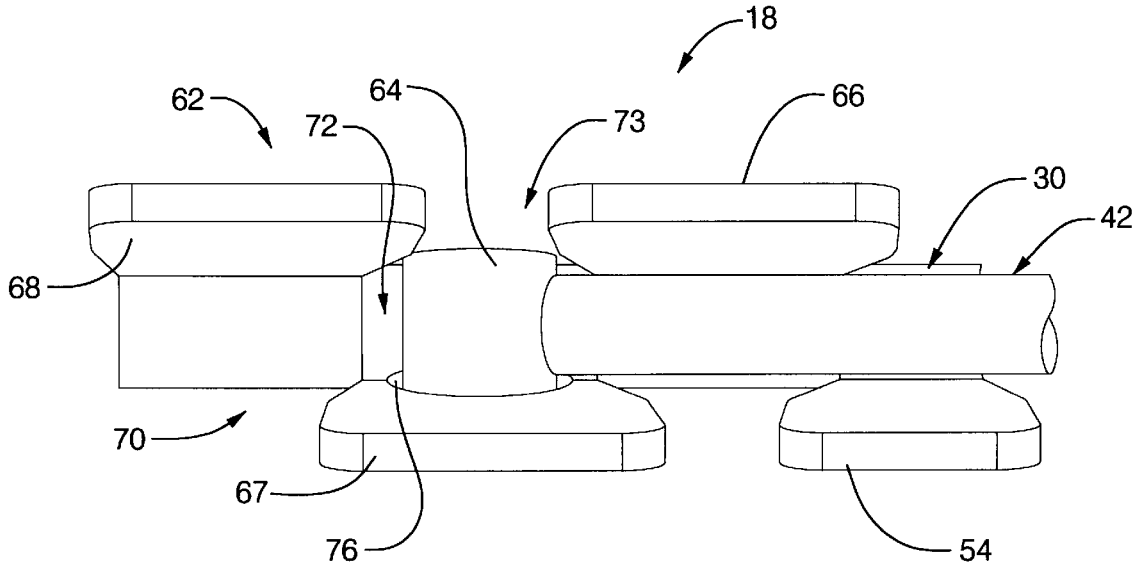
FIG. 4 is an expanded side view take along the lines 4—4 of FIG. 1.

As best shown in FIGS. 2 and 4, a seat 62 is provided to secure a cylindrical anchor 64 that is fixedly attached to the end of the accelerator cable 30. The seat 62 comprises three consecutive fingers 66–68 located at one end 70 of the channel 42. Similar to fingers 54, the ends of fingers 66–68 are swaged to form flukes 56. The width of these fingers 66–68 are greater than the width of the other fingers 54 that form the channel 42 so as to provide a sufficient space 72 between fingers 66, 68 to permit installation of the accelerator cable 30 and anchor 64 into the seat 62. The centrally-disposed finger 67 of the seat 62 includes a bore 76 opposing the space 72. The bore 76 has a diameter greater than that of the anchor 64 to retain and permit rotation of the anchor therein. Similarly, the space 72 between adjacent fingers 66, 68 of the seat 62 must be sufficiently close to retain the anchor 64 therebetween. The spacing 73 between the flukes 56 of fingers 66 and 68 must be greater than the gauge of the accelerator cable 30. The accelerator cable 30 is attached to the seat 62 of the return cam 18 by inserting the anchor 64 between fingers 66 and 68 and into the cavity defined by the bore 76 and spacing 72. The cable 18 then rides within the channel 42 of the return cam 18.

As shown in FIG. 1, the return cam 18 may include an idle stop lever 80 and a wide open stop lever 82 integrally extending therefrom. These stop levers 80, 82 engage a depending member 84 of the throttle housing 14 to limit the rotation of the throttle lever assembly 10 between the idle stop position and the wide open position. The idle stop lever 80 extends axially towards the housing 14 for engagement with an idle stop screw 86 threaded through the depending member 84. The screw 86 is adjustable to change the idle stop limit of the return cam 18. The idle stop lever 80 also engages the free end 90 of the return spring 34. The spring provides a rotational force against the idle stop lever 80 urging the return cam 18 back to the idle stop position.

Similarly, the wide open stop lever 82 extends axially towards the housing 14, from the return cam 18, opposite the channel 42 at an appropriate angle to engage the depending member 84 of the housing 14 at the wide open position.

The throttle housing 14 and the inner radial surface 38 of the planar body portion 36 of the return cam 18 maintain the return spring 34 in relative coaxial relation to the throttle shaft 22. One end (not shown) of the return spring 34 is retained in the throttle housing 14 while the free end 90 engages the idle stop lever 80 and planar body portion 36. The planar body portion 36 extends a sufficient distance radially about the shaft 22 mounted thereto to ensure the spring 34 does not contact the offset fingers 54. Referring to FIGS. 1–3, a cruise stud 98 may be attached to one of the fingers 54 of the channel 42 of the return cam 18 for receiving the cruise control cable or linkage 32. Preferably, the cruise stud 98 projects axially outward from the return cam 18 and has an end cap 100 to retain the cruise control cable or linkage 32 attached thereto. The location of the stud 98 about the periphery of the return cam 18 is determined by the location of the cruise control system relative to the return cam 18.

Figure 5:
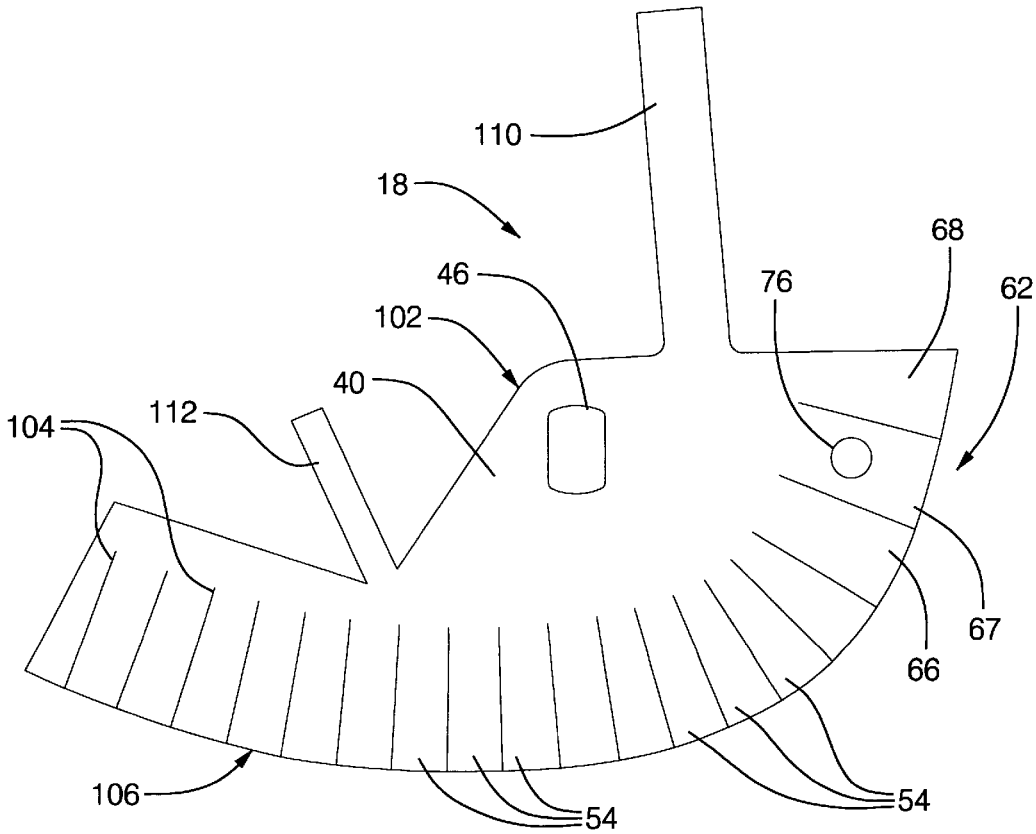
FIG. 5 is a top plan view of the return cam of the throttle lever assembly of FIG. 1 shown at a point during its manufacturing process.

An important feature of the present invention is the simplicity of forming the return cam 18 from a single planar metal plate blank 102. The return cam 18 is shown in FIG. 5 at a stage of manufacturing thereof. The plate blank 102 includes a plurality of relief cuts 104 disposed radially along the outer edge 106 of the return cam 18 which define the fingers 54 of the channel 42 and fingers 66–68 of the seat 62 for retaining the anchor 64. Finger 67 also includes a bore 76 for retaining the anchor 64. The planar plate blank 102 is also shaped to provide radially extending members 110, 112 which define the idle stop and wide open stop levers 80, 82, respectively of FIG. 1. The plate blank 102 is then stamped to alternately offset and expand the fingers 54, 66–68 that form the channel 42 and seat 62, as shown in FIGS. 2 and 3. If the return cam 18 is intended to be used with an engine having a cruise control system, the cruise stud 98, is mounted to the outer surface 40 of the return cam 18. Generally, the cruise stud is attached to a fluke 56 of one of the fingers 54 at the midpoint of the channel 42.

In the embodiment of the present invention shown in FIG. 1, each component of the throttle lever assembly 10 is integrated into a single return cam 18, however, one would recognize that integration of any combination of less than all of these components is possible. For example, the stop levers 80, 82 may be only integrated into the return cam 18, and the cruise stud 98 may only be integrated with the return cam 18.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A throttle lever for use in a throttle body assembly having a throttle housing and a return spring, the throttle lever comprising:

a shaft having first and second end portions, the second end portion attached to the throttle housing; and a unitary return cam attached to the first end portion of the shaft, the return cam having first and second radial surfaces with a channel disposed about a portion of the periphery of the return cam, the channel defined by a plurality of fingers offset to form first and second radial surfaces, whereby the channel is open radially outward for receiving an accelerator cable therein.

2. The throttle lever, as defined in claim 1, wherein the fingers have fluke-shaped end portions.

3. The throttle lever, as defined in claim 1, wherein the return cam further includes a stud projecting axially from the first radial surface of the return cam.

4. The throttle lever, as defined in claim 1, wherein the return cam is formed of a planar metal plate wherein the fingers are stamped to alternately offset the fingers.

5. The throttle lever, as defined in claim 4, wherein the return cam further includes a stop lever extending axially for engagement with a depending member extending from the throttle housing that defines the limit for an idle position.

6. The throttle lever, as defined in claim 1, wherein the return cam further includes a stop lever extending axially for engagement with a depending member extending from the throttle housing that defines the limit for a wide open position.

7. The throttle lever, as defined in claim 1, wherein the return cam includes a seat disposed at one end of the channel for securing the accelerator cable thereto.

8. The throttle lever, as defined in claim 7, wherein the seat includes three consecutive fingers alternately offset from the first and second radial surfaces of the return cam, the centrally-disposed finger having a bore for receiving and retaining the accelerator cable.

9. The throttle lever, as defined in claim 1, wherein the second radial surface of the return cam further includes a planar engagement surface disposed radially about the shaft for retaining the return spring in relative position to the shaft, a portion of the planar engagement surface extending radially a distance greater than the diameter of the return spring.

10. A throttle lever for use in a throttle body assembly having a throttle housing, the throttle lever comprising:

a return cam for attachment to the first end portion of the shaft, the return cam having first and second radial surfaces with a channel disposed about a portion of the periphery of the return cam, the channel defined by a plurality of flattened fingers forming a pair of substantially continuous walls, whereby the channel is open for receiving an accelerator cable therein.

11. A throttle lever as set forth in claim 10 wherein the throttle lever is a made as a unitary piece and the fingers are flattened by swaging.

* * * * *